US005819989A

United States Patent [19]

Saraceni

[11] Patent Number: 5,819,989

[45] Date of Patent: Oct. 13, 1998

[54] COMBINED LIQUID AND PAPER TOWEL DISPENSER

[76] Inventor: Joseph A. Saraceni, 500 Picket Way, West Chester, Pa. 19382

[21] Appl. No.: 895,822

[22] Filed: Jul. 17, 1997

Related U.S. Application Data

[60] Provisional application No. 60/021,974 Jul. 18, 1996.

[51] Int. Cl. [6] ..... B67D 5/06

[52] U.S. Cl. ..... 222/192; 222/383.1; 242/597.7

[58] Field of Search ..... 222/192, 383.1, 222/382, 324, 474; 239/333; 206/221, 233; 242/597.7, 597.8

[56] References Cited

U.S. PATENT DOCUMENTS

| | | | |
|---|---|---|---|
| 3,151,822 | 10/1964 | Glaner | 242/55.55 |
| 3,474,938 | 10/1969 | Clevenger | 239/333 |
| 3,797,749 | 3/1974 | Tada | 239/333 |
| 3,865,271 | 2/1975 | Gold | 221/96 |
| 4,436,224 | 3/1984 | McInerny | 222/183 |
| 4,643,338 | 2/1987 | Iizuka | 239/333 |
| 5,671,872 | 9/1997 | Daniels, Jr. | 222/192 |

OTHER PUBLICATIONS

Home Trends Catalog, p. 3, undated.

Instruction Sheet for "Handy Squirt" Dispenser, undated.

*Primary Examiner*—Philippe Derakshani

*Attorney, Agent, or Firm*—Richard C. Litman

[57] ABSTRACT

A combination dispenser for dispensing a cleaning solution and sheets of paper toweling from a roll. The combination dispenser comprises a container and a liquid dispensing fixture releasably secured to the container. The container has a neck portion and an integral base portion, which together form a chamber for receiving and storing a cleaning solution. The neck portion, which extends perpendicularly from and centrally of the base portion, is disposed to be inserted through the cardboard tube of a paper towel roll, rotatably to support the roll on the dispenser. A trigger-type spray nozzle has a cap for threaded engagement with the top of the neck portion to seal the container. The trigger-type spray nozzle also comprises a hose extending into the container for carrying the cleaning solution to the spray nozzle. A retaining member also is provided to prevent unraveling of paper towels from the roll. The invention may be scaled down in size, for use and storage on an automobile, boat, etc.

14 Claims, 8 Drawing Sheets

COMBINED LIQUID AND PAPER TOWEL DISPENSER

CROSS-REFERENCE TO RELATED APPLICATIONS

This application claims the benefit of U.S. Provisional Application Ser. No. 60/021,974 filed Jul. 18, 1996.

BACKGROUND OF THE INVENTION

1. Field of the Invention

The present invention relates to dispensers, and more particularly to dispensers for household cleaning products and dispensers for paper towels in roll form. Even more particularly, the present invention relates to a combined dispenser for cleaning solutions and including a supply of paper towels and structure to dispense towels.

2. Description of Related Art

It is often desirable to utilize paper products in combination with various cleaning solutions to effectively clean a particular surface. Due to the bulk of carrying, for instance, a roll of paper towels and a spray bottle filled with cleaning solution, it is difficult to apply cleaning solution to the surface or paper product, and then clean the surface. To accomplish the task it is necessary to apply the cleaning solution, set the liquid container aside, remove a paper towel, and then proceed to clean the surface This is particularly difficult when cleaning upright surfaces (such as car windows or home windows, etc.) where the cleaning solution tends to run.

The related art previously has addressed the long-felt need for combining together paper products dispensers and liquid dispensers. One such teaching is disclosed in U.S. Pat. No. 3,865,271, which issued to Max Gold on Feb. 11, 1975. The Gold device comprises a combination liquid or powder dispenser and toilet paper dispenser. The combination dispenser is disposed for mounting on a bathroom wall, placement into a toilet paper holder, or for use as a free standing device. One form of the Gold dispenser is not readily portable because it has to be mounted to a wall or placed within a toilet paper holder. A second embodiment: of the Gold dispenser, while portable, is not readily adapted for usage while the user repeatedly changes location. Rather, the portable embodiment is instead disposed for relocation to a new, relatively fixed position.

Another combination dispenser is disclosed in U.S. Pat. No. 3,151,822, which issued to Louis O. Glaner on Oct. 6, 1964. The Glaner dispenser is disposed for placement into a conventional toilet paper holder for dispensing both toilet paper and a pressurized deodorant. The deodorant dispenser is placed within the central bore of the cardboard toilet paper roll for dispensing deodorant upon forcing the dispensing head against the toilet paper holder. The dispensing of deodorant also may be performed manually by removing the dispenser from a toilet paper holder and compressing the dispensing head to release the deodorant.

Yet another combination dispenser is disclosed in U.S. Pat. No. 4,436,224, which issued to John McInerny on Mar. 13, 1984. The McInerny combination dispenser comprises a fluid containing base and neck portion for supporting a roll of paper towels, and a pump head releasably secured to the top of the neck portion for dispersion of the fluid contained in the base and neck portions. The combination dispenser also has an annular extension that projects upwardly from the base to retain the paper towels and assist in the separation of towels from the roll. The '224 dispenser is disposed for placement onto a horizontal surface such as a shelf or countertop, or for mounting onto a wall or cabinet.

Each of the above-listed dispensers provides a combination of products which normally are used together for a particular purpose. Each of the above-listed dispensers, however, are intended to be used at a particular location. While they are not necessarily fixed to a single location, the above-listed dispensers are not readily adapted for mobility during use. Thus, it would be advantageous at times to be able to use the dispenser repeatedly, such as while washing windows, without ever having to set down the dispenser.

One such dispenser is disclosed in a *Home Trends Catalog* and in an instruction sheet for a "Handy Squirt" dispenser of the type shown in the catalog. The dispenser includes a flat base with an upright tubular container and a trigger spray nozzle secured on top of the container. The upper end of the container is provided with a contoured grip portion. A retaining mechanism includes a roller arm having one end thereof loosely secured to the base and the other end thereof resiliently secured to the upper end of the container via an elastic member such as a rubber band.

The related art also contains various types of dispensing nozzles, such as trigger-type spray nozzles. One such form of trigger-type spray nozzle is intended to be used in conjunction with containers having an integral handle portion formed in the neck of the container. Other such trigger-type spray nozzles have utilized an integral handle on the nozzle apparatus to facilitate easy one-handed gripping of the trigger-type spray nozzle.

None of the above inventions and patents, taken either singly or in combination, is seen to describe the instant invention as claimed.

SUMMARY OF THE INVENTION

A combination dispenser of the present invention is provided for dispensing both a cleaning solution and paper towel sheets from a roll. The combination dispenser comprises an open container having a base member and an integral neck portion that extends perpendicularly from and centrally of the base member. The neck portion is adapted to be inserted through a cardboard tube rotatably to support the roll of towels on the container. The neck portion and base member receive and store a cleaning solution. A trigger-type spray nozzle has a cap for threaded engagement with the top of the neck portion to securably seal the container. The trigger-type nozzle also comprises a hose extending into the container for carrying the liquid contents to the spray nozzle. The trigger-type nozzle may additionally contain an integral handle portion to facilitate easy carrying of the combination dispenser.

The combination dispenser may also include a towel retainer to prevent the roll of towels from unraveling. A first embodiment uses an arcuate towel retainer that extends upwardly and vertically from the upper surface of the base portion. The arcuate retainer has an opening along one side of the base such that the opening provides a space through which paper towels may be drawn from the roll. A second embodiment uses a disc having a second arcuate retainer depending from its lower side so that the retainer covers the upper end of the paper towel roll. The second arcuate retainer has a similar opening aligned with the opening on the first arcuate retainer. A third embodiment uses a spine attached to the top of the base at a region having an expanded diameter, and the spine has on its upper end an open ring structure disposed to retain the roll of paper towels. An opening in the ring allows paper towels to be removed from the roll.

According to another embodiment of the present invention, the combination dispenser comprises an open container having a base member and an integral neck portion that extends perpendicularly from and centrally of the base member. The neck portion is is inserted through the cardboard tube to rotatably support the roll of towels on the container. The neck portion and base member receive and store a cleaning solution. A trigger-type spray nozzle has a cap for threaded engagement with the top of the neck portion to seal the container. The trigger-type nozzle also comprises a hose extending into the container for carrying the liquid contents to the spray nozzle. To prevent unraveling of paper towel from the paper towel roll, a retaining member is removably attached to the container. The retaining member includes a first portion having one end with an aperture through which the neck portion is inserted, and a second portion integral with the first portion at its opposite end. The second portion angularly depends from the first portion, whereby the second portion is biased into a first position and flexible for movement into a second position so that the second portion may be tensioned against the paper towel roll.

Accordingly, it is a principal object of the invention to provide a combination paper towel and cleaning solution dispenser that allows an individual to retain the dispenser in one hand for discharging its contents, and to grasp paper towels, as needed, with the other hand.

It is another object of the invention to provide a combination dispenser that is easily and readily operated while the device is carried.

It is a further object of the invention to provide a combination paper towel and cleaning solution dispenser having a retaining member for preventing unwanted unrolling of the paper towels during use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
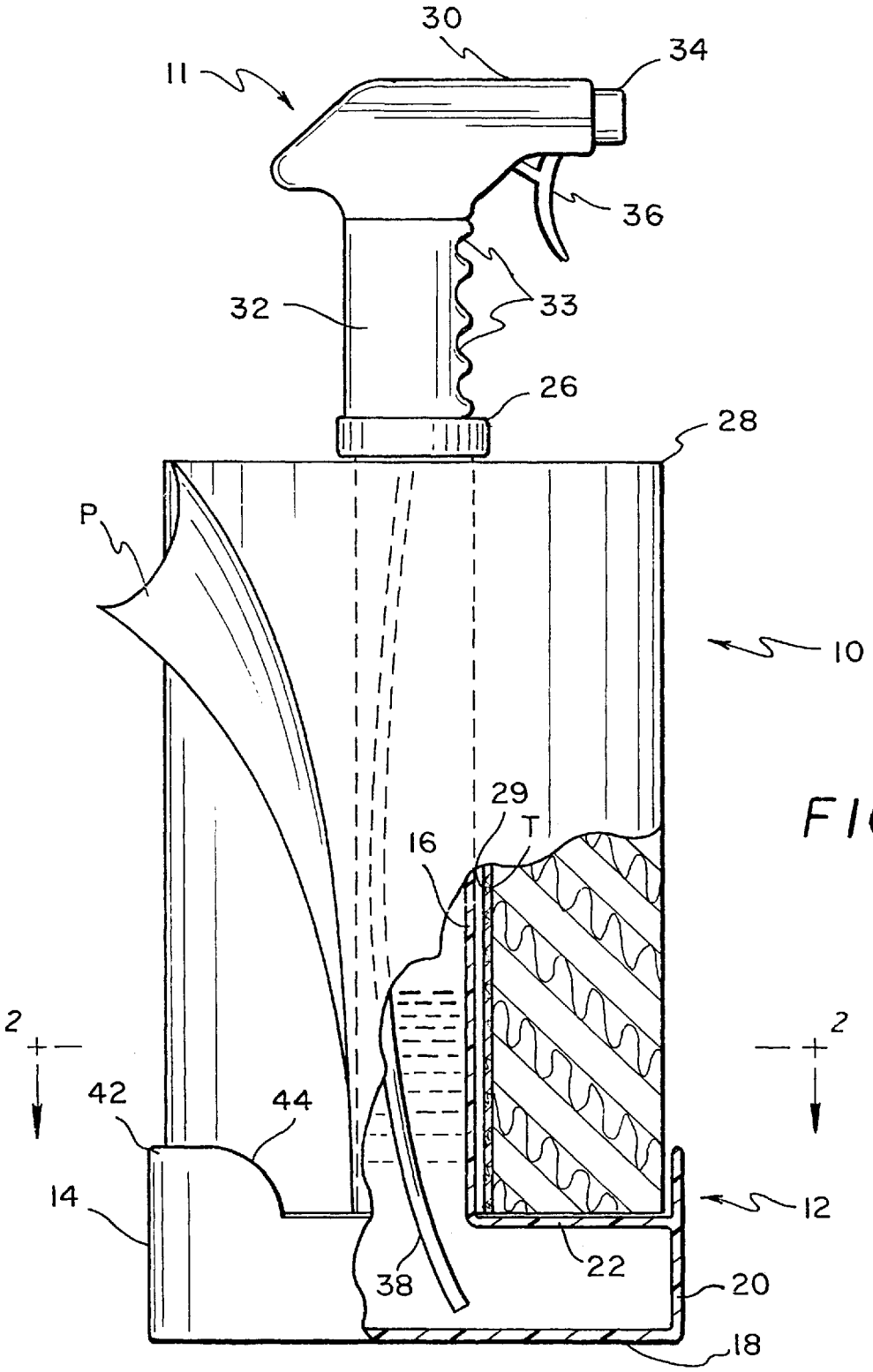
FIG. 1 is side elevational view of a dispenser according to a first embodiment of the present invention, with a portion of the paper towel roll and the base member broken away to expose the interior of the container and show the relationship between the roll of towel and the towel retaining flange.

Referring to the drawings by numerals of reference, and first to FIGS. 1–3, 10 refers generally to a combination paper towel and cleaning solution dispenser according to a first embodiment of the present invention. The dispenser 10 generally comprises a liquid container 12 and a liquid dispensing fixture 11. The container 12 is formed of a base portion 14 and an integral, elongate neck portion 16, which together define the chamber which receives and stores a cleaning solution. The base portion 14 has a broad cylindrical shape with a planar bottom surface 18, a planar upper surface 22, and an annular outer wall 20 extending therebetween. Together the bottom surface 18, upper surface 22, and annular outer wall 20 define a central cavity therein. The neck portion 16 is a cylindrical tube that extends perpendicularly upwardly from substantially the center of upper surface 22. The neck portion 16 includes a hollow interior which is in communication with the cavity defined by the base portion. A lower end of neck portion 16 connects to base portion 14 to join the neck portion and base portion in fluid communication. An upper end 24 of neck portion 16 defines an outlet aperture 21 through which cleaning solution may be poured into or out of container 12. The upper end 24 also is provided with a plurality of threads 25 (shown in FIG. 3) formed around its outer circumference releasably to secure cap 26, as discussed hereinafter.

A typical paper towel roll, generally referenced at 28, has an inner cardboard tube T around which is wrapped a continuous web of material formed as a plurality of paper towels P separated by lines of perforation. The cardboard tube T has a generally cylindrical shape with a central bore 29. The central bore 29 has a diameter slightly larger than the outer diameter of the elongate neck portion 16, which is inserted into central bore 29. When neck portion 16 is fully inserted into central bore 29, the paper towel roll 28 is supported on base 14 for rotation about neck portion 16. The upper end 24 extends beyond the top of paper towel roll 28 so that threads 25 on upper end 24 are accessible.

A liquid dispensing fixture, generally referenced at 11, is releasably secured to the threaded upper end 24 of neck portion 16. The liquid dispensing fixture 11 is a conventional trigger-type spray pump having a cap 26 for securing the fixture 11 to container 12, a grip portion 32 for grasping by a user, a pump head 30 that contains spray nozzle 34 and a trigger 36, and a fluid conducting tube 38 that carries cleaning solution from container 12 to pump head 30. Cap 26 has a plurality of internal threads (not shown) which allow it to screw onto the threaded upper end 24 of neck portion 16 and thereby seal the junction between container 12 and the liquid dispensing fixture 11.

When cap 26 is secured to container 12, the fluid conducting tube 38 extends down the length of neck portion 16 and into base portion 14. When a user depresses trigger 36, cleaning solution in the pump head 30 is forced to spray from nozzle 34 and additional cleaning solution is drawn upwardly through conducting tube 38 to the pump head. Grip portion 32 has a plurality of spaced depressions 33 which properly position the hand of a user for ergonomic retention of the dispenser 10, and easy manipulation of trigger 36.

Figure 2:
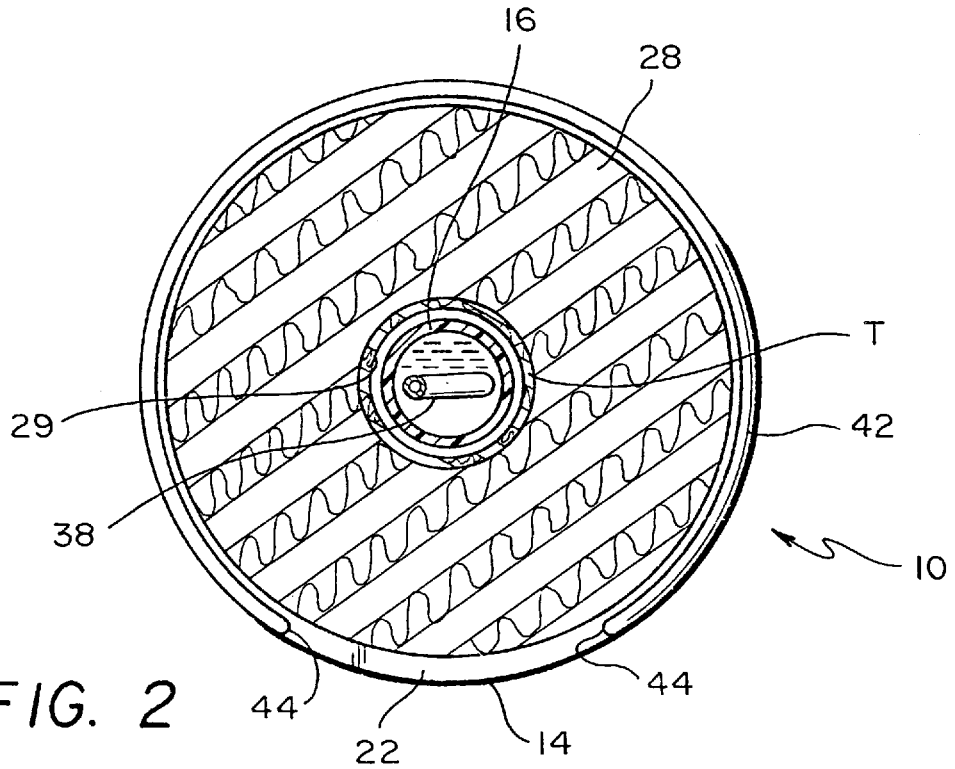
FIG. 2 is a cross-sectional view taken along lines 2—2 of FIG. 1.
Figure 3:
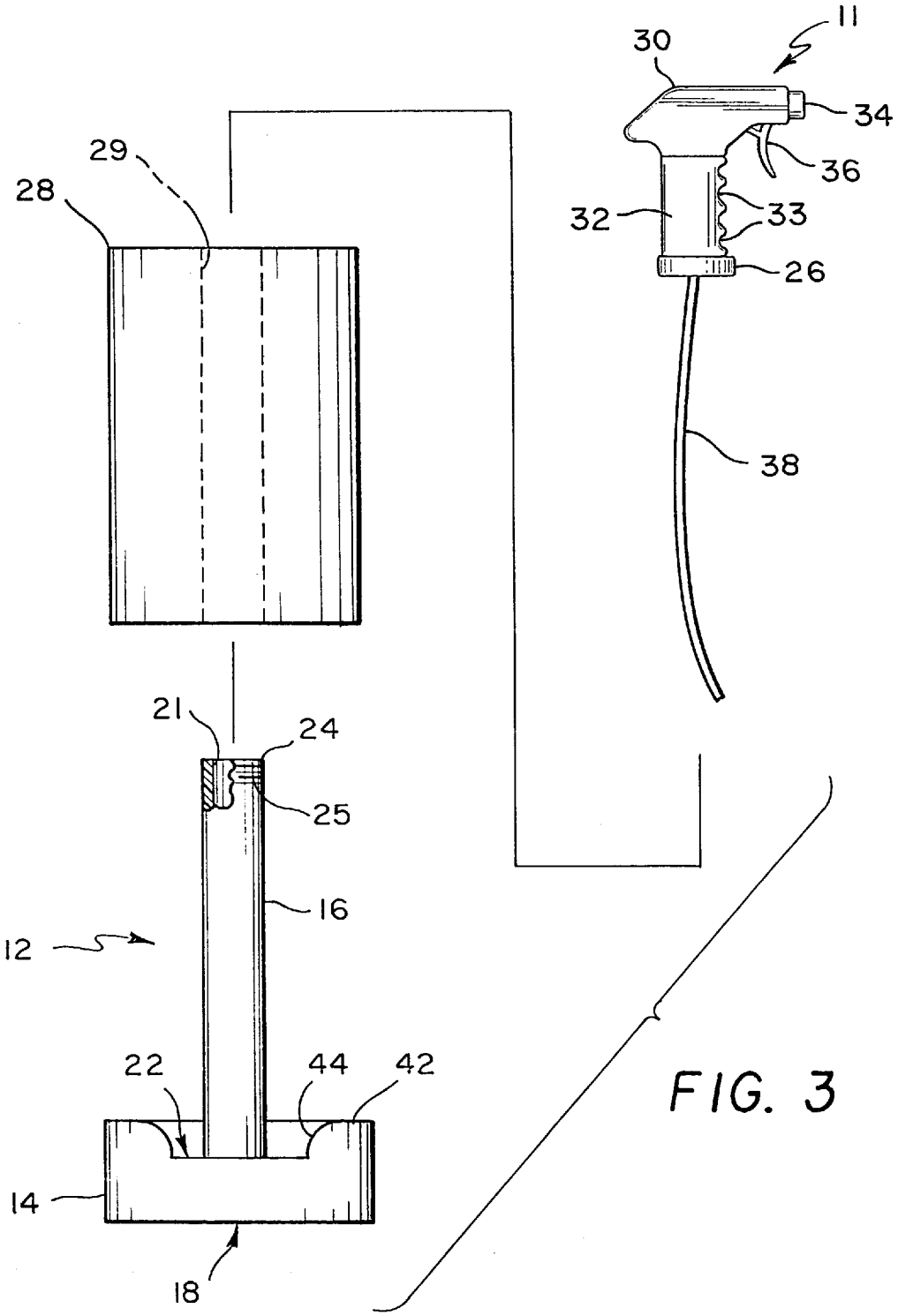
FIG. 3 is an exploded view of the dispenser, showing the relationship between the container, the roll of paper towels to be placed onto the container, and the trigger-type spray nozzle used to dispense the cleaning solution stored within the container.

According to the first embodiment shown in FIGS. 1–3, the base portion 14 further includes an integral, arcuate paper towel retainer 42 which extends perpendicularly from the upper surface 22 of base portion 14. The arcuate retainer 42 lies at a distance from neck portion 16 which adequately accommodates the paper towel roll 28; i.e., the distance between opposite sides of the arcuate retainer 42 is greater than the thickness of the paper towel roll 28. Preferably, and for ease of manufacture, the arcuate retainer 42 has a radius equal to the outer wall 20 of base portion 14, as shown in FIG. 1. Arcuate retainer 42 extends around approximately three-fourths of the circumference of base portion 12. The ends 44 of arcuate retainer 42 taper to the upper surface 22 of base portion 20 to form a gap through which a user may remove an individual paper towel. The arcuate retainer 42 functions to prevent unravelling of the paper towel roll from its lower end.

Figure 4:
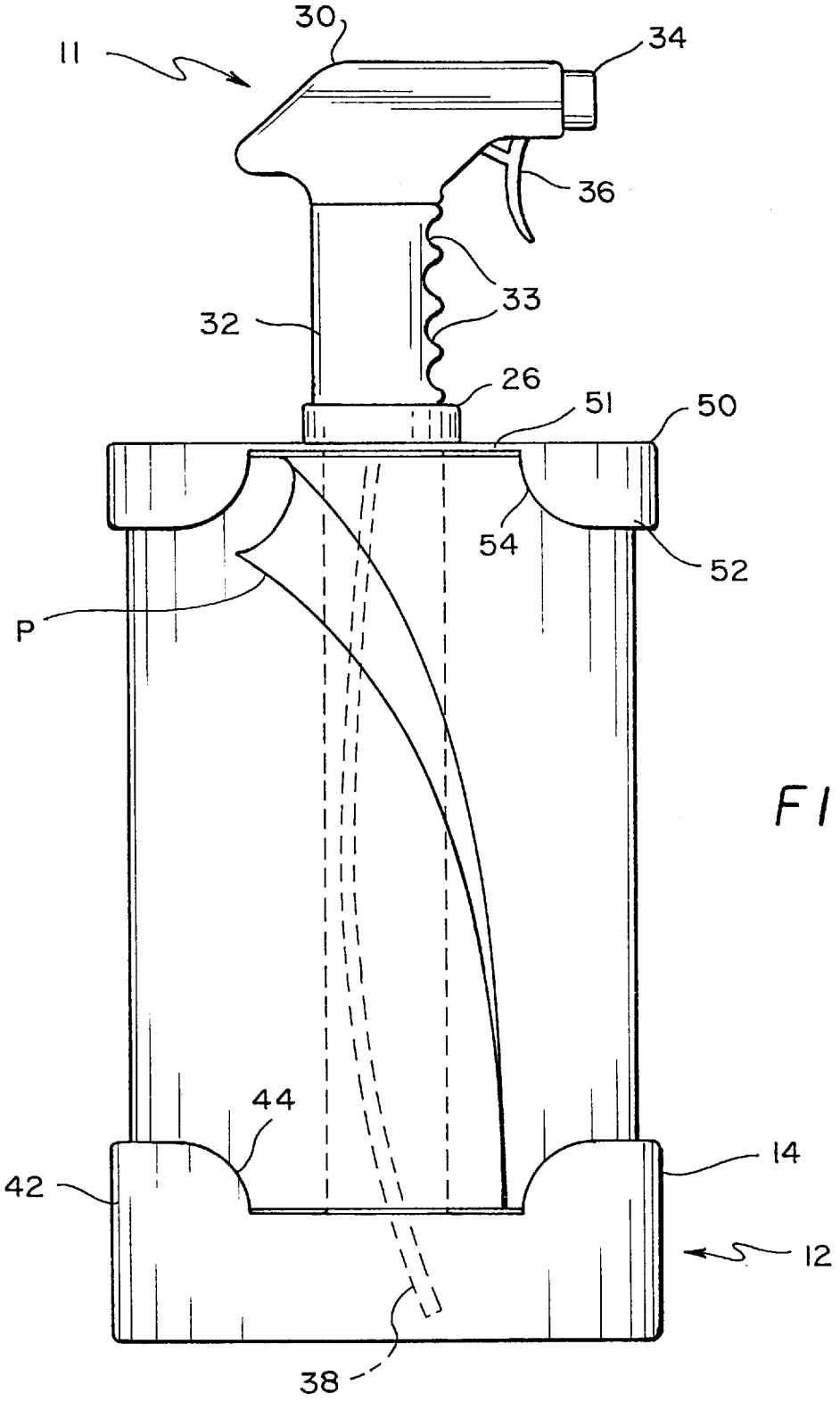
FIG. 4 is a side elevational view of a dispenser according to a second embodiment of the present invention, which utilizes a pair of towel retaining flange elements.

According to a second embodiment shown in FIG. 4, the dispenser 10 may also be provided with a retaining member 50. Retaining member 50 comprises a generally circular disc 51 that has an inner aperture (not shown) for placement around neck portion 16, and an arcuate retainer 52 that extends from the lower side of disc 51 adjacent its outer circumference. The arcuate retainer 52 lies at a distance from neck portion 16 which adequately accommodates a paper towel roll 28; i.e., the distance between opposite sides of the arcuate retainer 52 is greater than the thickness of a new paper towel roll 28. Preferably, arcuate retainer 52 has a radius equal to the radius of arcuate retainer 42. Arcuate retainer 52 extends around approximately three-fourths of the circumference of disc 51 with the ends 54 thereof tapering to the lower side of disc 51 to form a gap through which a user may remove an individual paper towel. When both arcuate retainers 42 and 52 are present together, as in FIG. 4, the arcuate retainers function to prevent unravelling from either end of the paper towel roll.

Figure 6:
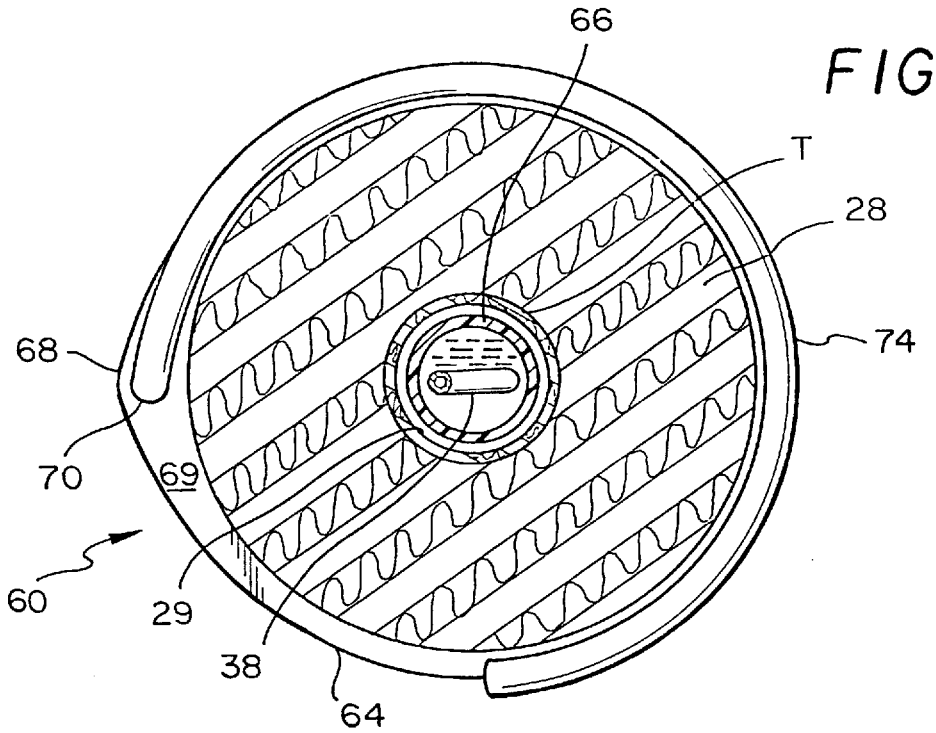
FIG. 6 is a cross-sectional view taken along line 6—6 of FIG. 5.
Figure 5:
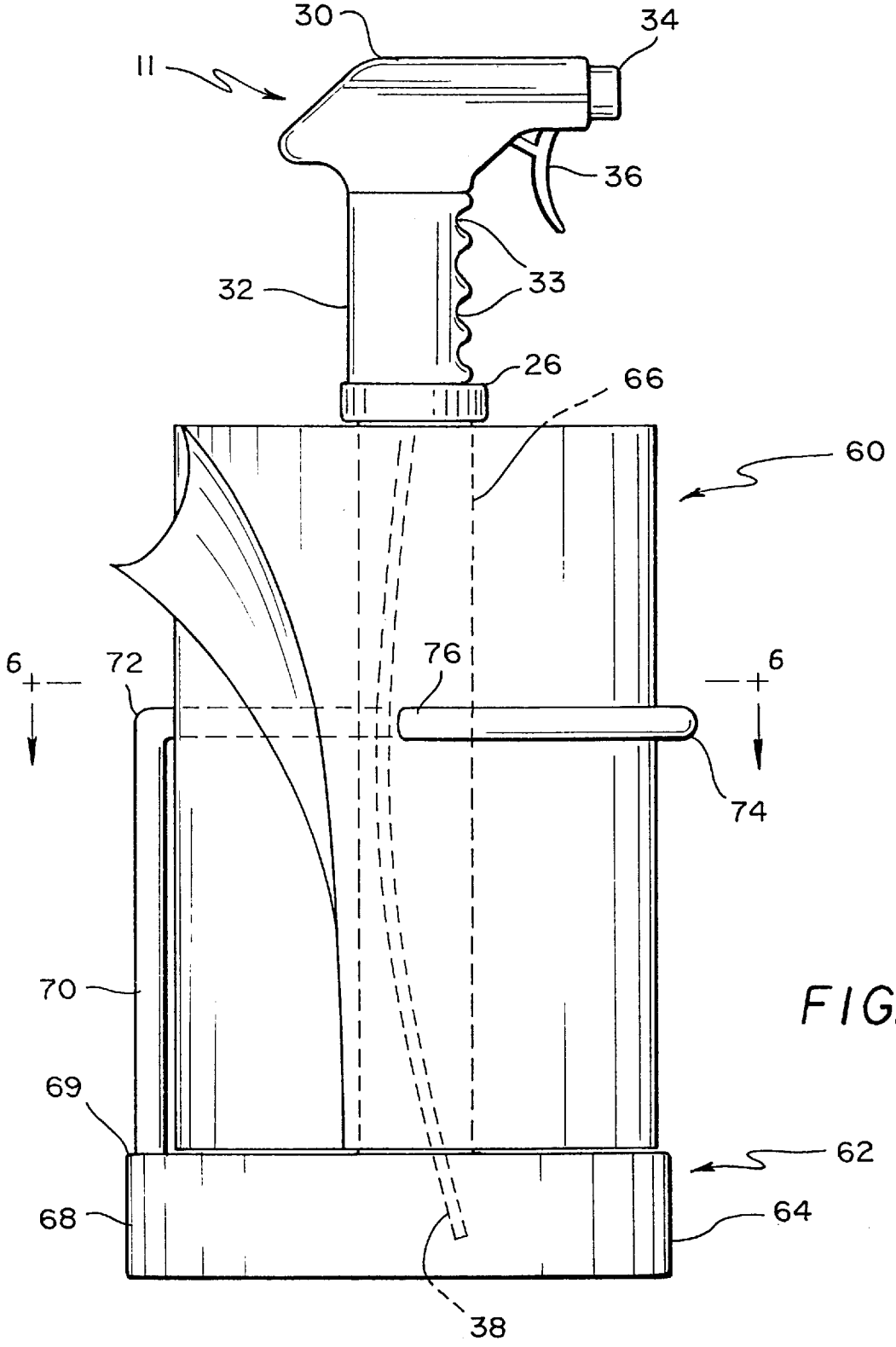
FIG. 5 is a side elevational view of a dispenser according to a third embodiment of the present invention, which utilize an expanded diameter portion on the base member to support a spine with a towel retaining open ring structure at its upper end.

According to a third embodiment shown in FIGS. 5–6, the dispenser 60 uses a modified container 62. Container 62 comprises a base portion 64 and an integral neck portion 66, which are connected as previously described for the first embodiment. The base portion 64, however, has a bulge 68 on one side thereof that provides an upper surface 69 with which a cylindrical spine 70 integrally connects. Spine 70 extends perpendicularly upwardly from the surface 69 for a distance slightly greater than half the length of a paper towel roll 28. Integrally connected to the upper end 72 of spine 70 is a partial or open ring structure 74 that is supported at a fixed distance above base portion 64 and equidistant from neck portion 66. The open ring structure 74 has a radius slightly larger than the thickness of a new paper towel roll 28, and because the open ring structure is equidistant from neck portion 66, it adequately accommodates a paper towel roll 28. A gap exists between an end 76 of the open ring structure 74 and spine 70 through which a user may remove an individual paper towel. The open ring structure 74 functions to prevent unravelling of the paper towel roll 28.

To assemble the dispenser 10,60, container 12,62 is first filled with a cleaning solution such as, for example, a commercially available glass cleaner or an ammonia and water solution. Next, a paper towel roll 28 is placed over container 12,62 with its central bore 29 aligned with elongate neck portion 16,66. As the paper towel roll 28 is brought downward, neck portion 16,66 inserts into central bore 29 with its upper end 24. The lower end of paper towel roll 28 rests on the upper surface 22 of base portion 12,62 such that the upper end 24 of neck portion 16,66 extends above the top of the paper towel roll 28. The liquid conducting tube 38 is inserted into neck portion 66 as the liquid dispensing fixture 30 is placed onto the upper end 24 of neck portion 16. Once conducting tube 38 is fully inserted into neck portion 16,66, cap 26 is screwed onto the threaded upper end 24 to seal container 12, which prevents spillage and allows the pump head 30 to function.

In use, a user may grasp dispenser 10,60 by its grip portion 32 and carry the dispenser to the surface (i.e., a storm window or automobile window) to be cleaned. Either before or after spraying the cleaning solution of container 12 (using trigger 36 to eject the liquid from spray nozzle 34), the user may grasp a paper towel P to wipe the surface in need of cleaning. If the user requires another towel or additional cleaning solution, he or she may choose either without having to set down the dispenser 10,60. Because grip portion 32 is contoured to receive a hand, it will be unlikely that the user's hand becomes cramped during the cleaning process.

Figure 7:
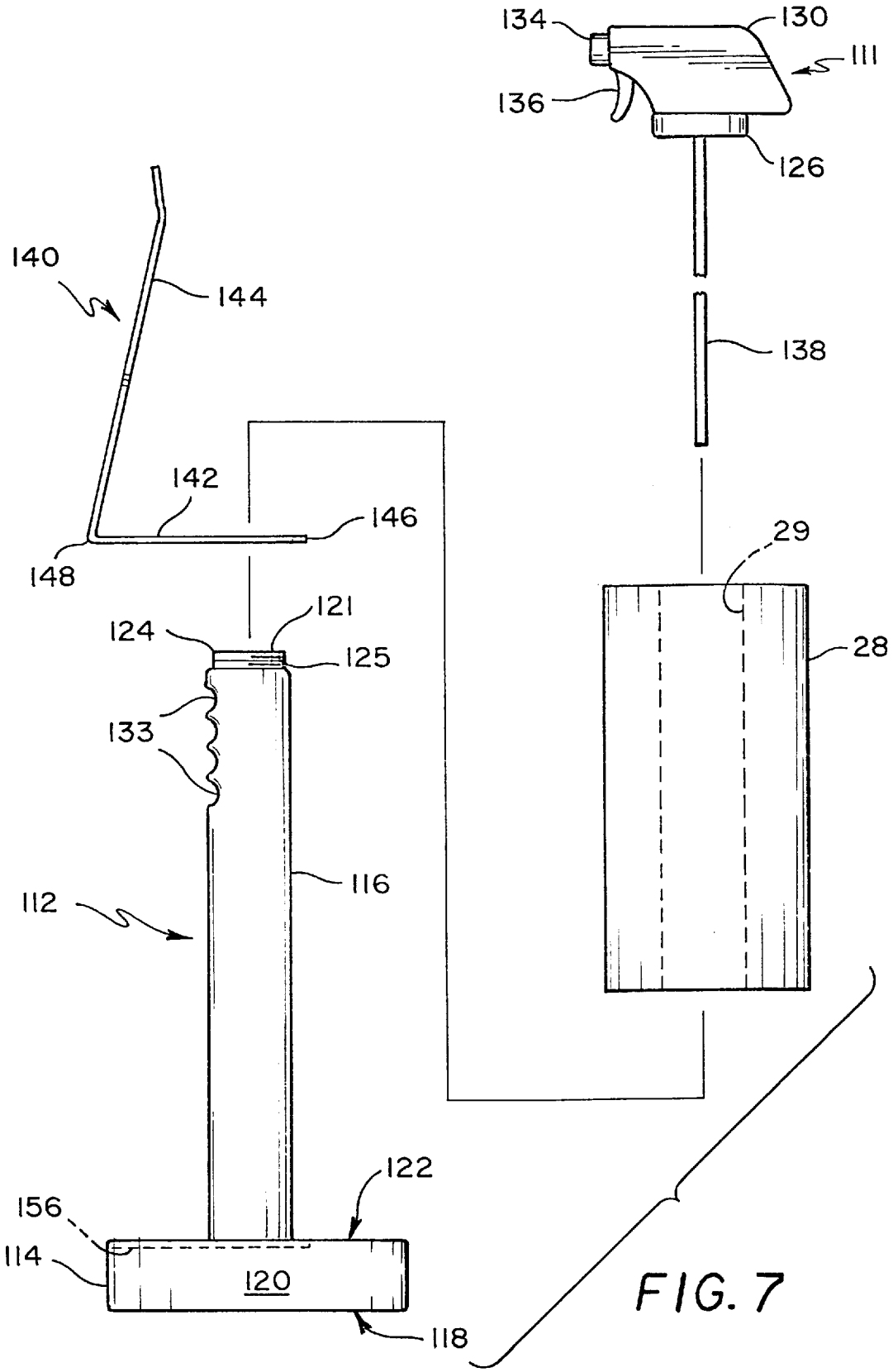
FIG. 7 is an exploded view of a dispenser according to a fourth embodiment of the present invention.
Figure 8:
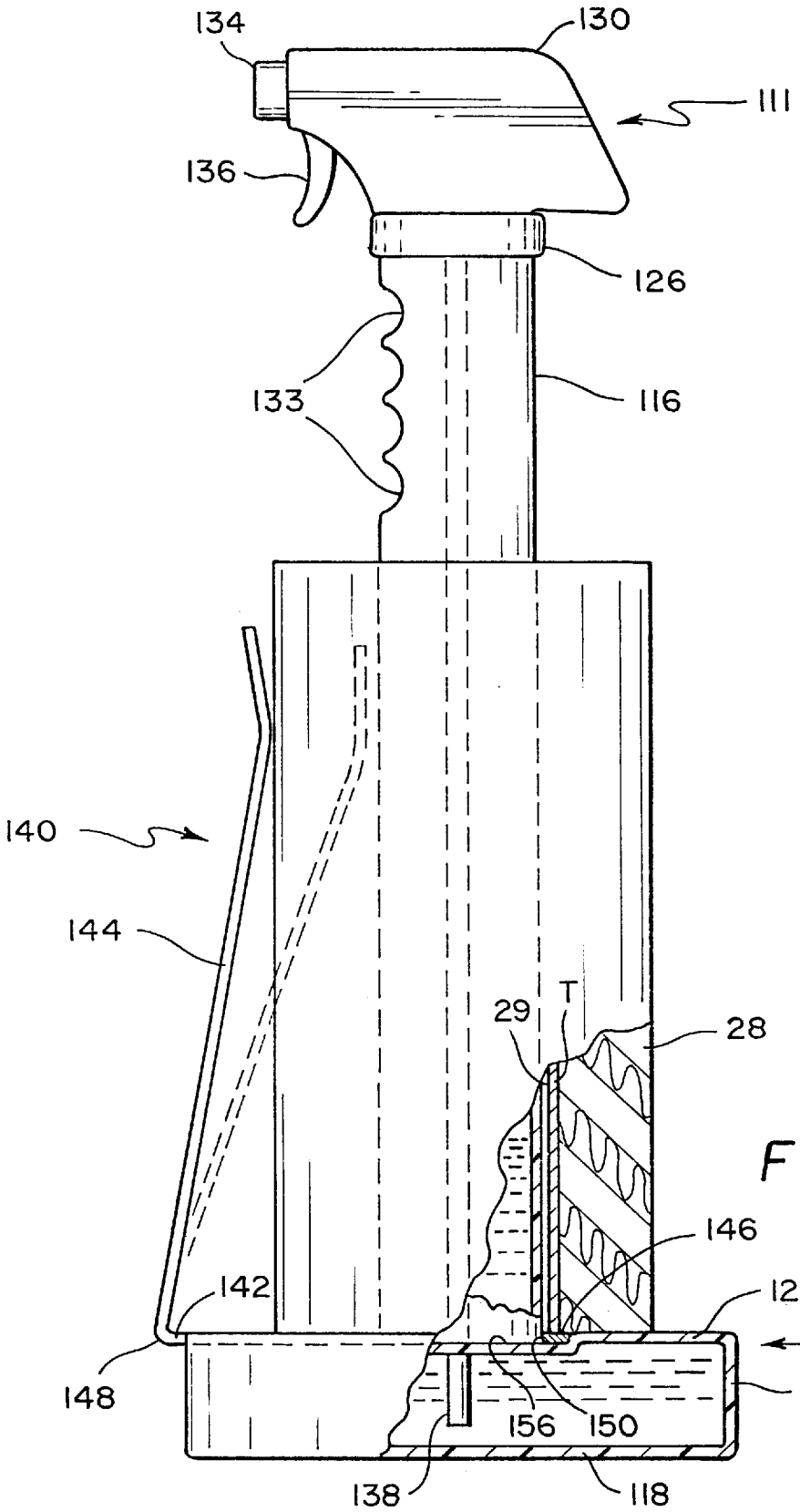
FIG. 8 is a side elevational view of the dispenser according to the fourth embodiment with a portion of the container and paper towel roll broken away to illustrate the relationship between the retaining member and the container.
Figure 9:
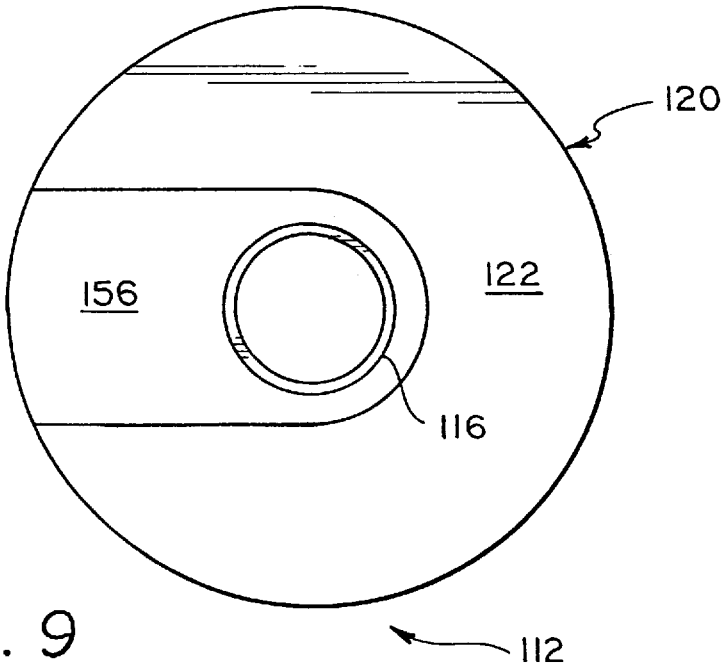
FIG. 9 is a top plan view of the container according to the fourth embodiment.

Referring generally now to FIGS. 7–9, a dispenser 110 according to a fourth embodiment of the present invention is shown. The dispenser 110 generally comprises a liquid container 112, a liquid dispensing fixture 111, and a retaining member 140. The container 112 is formed of a base portion 114 and an integral, elongate neck portion 116, which together define the chamber which receives and stores a cleaning solution. The base portion 114 has a broad cylindrical shape with a planar bottom surface 118, a planar upper surface 122, and an annular outer wall 120 extending therebetween. Together the bottom surface 118, upper surface 122, and annular outer wall 120 define a central cavity therein. The neck portion 116 is a cylindrical tube that extends perpendicularly upwardly from substantially the center of upper surface 122. The neck portion 116 includes a hollow interior which is in communication with the cavity defined by the base portion. A lower end of neck portion 116 connects to base portion 114 to join the neck portion and base portion in fluid communication. An upper end 124 of neck portion 116 defines an outlet aperture 121 through which cleaning solution may be poured into or out of container 112.

The upper end 124 also is provided with a plurality of threads 125 (shown in FIG. 7) formed around its outer circumference for securing the liquid dispensing fixture 111 onto the container 112. In addition, neck portion 116 includes a grip portion formed thereon adjacent to the upper end 124. The grip portion has plurality of spaced depressions 133 aligned along one side of the neck portion 116. The depressions 133 are disposed to receive the fingers of a user during use of the dispenser 110.

As described with respect to the dispenser 10, the elongate neck portion 116 also is sized for insertion into the central bore 29 of the paper towel roll 28. When neck portion 116 is fully inserted into central bore 29, the paper towel roll 28 is supported upon base 114 for rotation about neck portion 116 and the upper end 124 extends beyond the top of paper towel roll 28 so that the threads 125 thereon are accessible.

The liquid dispensing fixture 111 is disposed for being releasably secured to the threaded upper end 124 of neck portion 116. The liquid dispensing fixture 111 is a conventional trigger-type spray pump having a cap 126 for securing the fixture to container 112, a pump head 130 that contains a spray nozzle 134 and a trigger 136, and a fluid conducting tube 138 that carries cleaning solution from container 112 to pump head 130. Cap 126 has a plurality of internal threads (not shown) which allow it to screw onto the threaded upper end 124 of neck portion 116 and thereby seal the junction between container 112 and the liquid dispensing fixture 111. When cap 126 releasably is secured to container 112, the fluid conducting tube 138 extends down the length of neck portion 116 and into the cavity defined by the base portion 114. When a user depresses trigger 136, cleaning solution in the pump head 130 is forced to spray from nozzle 134 and additional cleaning solution is drawn upwardly through conducting tube 138 to the pump head.

The retaining member 140 is removably attached to the container 112 for retaining paper towels against unraveling from the paper towel roll 28. Retaining member 140 has a unitary structure, including a first portion 142 and a second portion 144 angularly depending from the first portion. The first portion 142 has opposed ends 146, 148 with an aperture 150 formed through the end 146. Aperture 150 is sized and configured for insertion of the neck portion 116 through the aperture so that the first portion 142 of the retaining member may rest against the base portion 114. In the embodiment shown, the neck portion is substantially cylindrical; the aperture 150 is, therefore, substantially circular and has a diameter slightly larger than the diameter of the neck portion. The second portion 144 depends from the opposite end 148 to form an angle a therebetween. The second portion 144 is normally biased toward a first position, where the second portion 144 is at equilibrium with respect to its angular position in relation to the first portion 142. The angle $\alpha$ is between about 45° and 85°, and more preferably between about 50° and 80° when the second portion 144 is in the first position. The second portion 144 is intended to be flexed in relation to the first portion 142 for movement into a second position, where the second portion is tensioned for returning to the first position. In use, the angle $\alpha$ is at most 90° when the second portion 144 is in the second position (shown at FIG. 8).

The first portion 142 of the retaining member 140 may rest upon the upper surface 122 while it is releasably attached to the container 112; it is desirable, however, to provide the base portion 114 with a recess 156 formed into the upper surface thereof for receiving the first portion 142. The recess 156 is sized and configured to receive the first portion 142 of the retaining member. Therefore, the recess 156 extends inwardly from the perimeter of the upper surface 122 and surrounds the junction between the neck portion 116 and the base portion 114. This is sufficient to accommodate the end 146 of the first portion which contains the aperture 150. To avoid interference, albeit minor, between the paper towel roll 28 and the first portion 142, the recess 156 is of sufficient depth to prevent the first portion from extending above the planar upper surface 142.

To utilize the combination dispenser 110, a user may fill the container 112 with a cleaning fluid, then place the retaining member 140 onto the container 112 such that neck portion 116 is inserted through aperture 150 thereof. With the retaining member 140 properly positioned on the container 112, the paper towel roll 28 is next placed onto the container by fully inserting the neck portion 116 through the central bore 29 of the paper towel roll until the upper end 124 is exposed. To achieve the previous step it will be necessary to manually urge the second portion 144 of the retaining member 140 away from the first position toward the second position. When the paper towel roll 28 is properly situated for rotation about the neck portion 116, the second portion 144 of the retaining member is released, whereby it is resiliently urged toward the first position until it contacts the paper towel roll. Finally, the liquid dispensing fixture 111 is releasably secured to the threaded upper end 124 of the neck portion 116, thereby sealing the container 112.

The tension of the retaining member 140 is sufficient to) prevent unraveling of the paper towel roll, yet not so great that it will interfere significantly with rotation of the paper towel roll (i.e., for dispensing one or more paper towels from the roll). Thus, while holding the dispenser about the grip portion, a user may spray the contents of the container with one hand and grasp paper towels, as needed, with the other hand. As paper towels are removed from the paper towel roll, it should be apparent that the second portion 144 of the retaining member will maintain contact with the paper towel roll 28 as it becomes smaller in diameter through the course of its use.

While the present invention has been described in connection with a dispenser intended to be used for dispensing a liquid cleaning solution, it should be apparent to one skilled in the art that other liquids, such as plain water, may also be stored inside container.

It should be further understood and recognized that the present invention may be scaled down in size for ease of portability, thus making its use suitable for storage within an automobile, boat, etc.

It is to be understood that the present invention is not limited to the embodiments described above, but encompasses any and all embodiments within the scope of the following claims.

I claim:

1. A dispenser for liquids and paper towels, the dispenser comprising:

a liquid container comprising:

a base portion with a generally flat bottom surface, a upper surface, and an outer wall extending between said bottom surface and said top surface to define a cavity;

an elongate neck portion having a hollow interior in communication with the cavity of said base portion, said elongate neck portion extending perpendicularly from said upper surface of said base portion, said elongate neck portion being sized and configured to extend through a central bore of a paper towel roll for rotatably supporting the paper towel roll thereon, and an end of said elongate neck portion extending above the paper towel roll; and an outlet aperture at said end of said elongate neck portion;

a liquid dispensing fixture comprising:

a cap adapted releasably to be secured over said outlet aperture, and a manually operated pump integral with said cap, said pump having a nozzle and an elongate tube in fluid communication with said nozzle and the cavity of said base portion; and retaining means releasably attached to said container for retaining paper towels against unraveling from the paper towel roll, said retaining means comprising:

a retaining member having a first portion and a second portion angularly depending from said first portion, said first portion having opposed ends with engaging means at one end thereof for engaging said container, said second portion depending from the other end of said first portion to form an angle therebetween, said second portion being biased toward a first position and flexible for movement into a second position.

2. The dispenser according to claim 1, wherein said engaging means comprise an aperture formed in said one end, said aperture being sized and configured to receive said elongate neck portion.

3. The dispenser according to claim 1, wherein the angle between said first portion and said second portion is between about 45° and 90° at said first position.

4. The dispenser according to claim 3, wherein the angle between said first portion and said second portion is between about 50° and 80° at said first position.

5. The dispenser according to claim 1, wherein the angle between said first portion and said second portion is at most 90° at said second position.

6. The dispenser according to claim 1, wherein said upper surface of said base includes a recess sized and configured to receive a portion of said retaining means.

7. The dispenser according to claim 6, wherein:

said upper surface is substantially planar; and said portion of said retaining means lies entirely within said recess.

8. The dispenser according to claim 6, wherein said recess in said upper surface extends inwardly from the perimeter of said upper surface and surrounds the junction between said neck portion and said base portion.

9. The dispenser according to claim 1, wherein said end of said elongate neck portion includes a grip portion having a plurality of spaced depressions aligned along one side of said elongate neck portion.

10. A dispenser for liquids and paper towels, the dispenser comprising:

a liquid container made up of:

a base portion having a generally flat bottom surface and an upper surface;

an elongate neck portion extending perpendicularly from said upper surface of said base portion, said elongate neck portion being adapted to extend through a central bore of a paper towel roll for supporting the roll for rotation thereon, and an end of said elongate neck portion extending above the paper towel roll; and an outlet aperture at the upper of said elongate neck portion; and a liquid dispensing fixture comprising:

a cap adapted releasably to be secured over said outlet aperture;

a grip portion adapted for receiving the hand of a user;

a manually operated pump integral with said grip portion, said pump having a nozzle and an elongate tube in fluid communication with said nozzle and said base portion of said container and a retaining means for retaining paper towels against unraveling from the paper towel roll, said retaining means comprising an arcuate retainer adapted partially to surround the lower end of the paper towel roll, said arcuate retainer being integrally connected to said upper surface and extending perpendicularly upwardly from said upper surface adjacent the perimeter thereof.

11. The dispenser according to claim 10, wherein said retaining means further comprise:

a generally planar disc having upper and lower surfaces, and a central aperture for placement of said disc around said elongate neck portion; and a second arcuate retainer adapted partially to surround the upper end of the paper towel roll, said second arcuate retainer being integral with said lower surface and extending perpendicularly downwardly from said lower surface adjacent the perimeter of said disc.

12. The dispenser according to claim 10, wherein said grip portion comprises a plurality of aligned, spaced depressions on one side of said grip portion.

13. The dispenser according to claim 10, wherein said pump further comprises a trigger operable for movement between a first position and a second position, said trigger forcing fluid from said pump to eject through said nozzle and drawing fluid from said container into said pump when said trigger is urged from said first position into said second position.

14. A dispenser for liquids and paper towels, the dispenser comprising:

a liquid container made up of:

a base portion having a generally flat bottom surface and an upper surface;

an elongate neck portion extending perpendicularly from said upper surface of said base portion, said elongate neck portion being adapted to extend through a central bore of a paper towel roll for supporting the roll for rotation thereon, and an end of said elongate neck portion extending above the paper towel roll; and an outlet aperture at the upper of said elongate neck portion; and a liquid dispensing fixture comprising:

a cap adapted releasably to be secured over said outlet aperture;

a grip portion adapted for receiving the hand of a user;

a manually operated pump integral with said grip portion said pump having a nozzle and an elongate tube in fluid communication with said nozzle and said base portion of said container; and a retaining means for retaining paper towels against unraveling from the paper towel roll, said retaining means comprise:

a spine integrally connected to and extending perpendicularly upwardly from said upper surface of said base portion adjacent the perimeter of said upper surface; and an open, incomplete ring structure integrally connected to the end of said spine, said incomplete ring being positioned in coaxial relation to said elongate neck portion, and said incomplete ring having a radius sized to accommodate the roll of paper towels.

* * * * *